US006681465B1

(12) United States Patent
Kerr

(10) Patent No.: US 6,681,465 B1
(45) Date of Patent: Jan. 27, 2004

(54) MODEL SHIP TOOL FOR REEVING AND SPACING DEADEYES AND SHEAVES

(76) Inventor: Robert E. Kerr, 150 Town and Country Dr., Norway, ME (US) 04268

( * ) Notice: Subject to any disclaimer, the term of this patent is extended or adjusted under 35 U.S.C. 154(b) by 0 days.

(21) Appl. No.: 10/214,137

(22) Filed: Aug. 8, 2002

(51) Int. Cl.[7] ..... B25B 27/14

(52) U.S. Cl. ..... 29/281.5; 29/281.1; 269/309; 269/313

(58) Field of Search ..... 29/281.5, 281.1; 269/43, 903, 313, 314, 311, 309

(56) References Cited

U.S. PATENT DOCUMENTS

| | | | | |
|---|---|---|---|---|
| 3,871,127 A | | 3/1975 | Heath | 46/93 |
| 4,412,499 A | | 11/1983 | Hall | 114/108 |
| 4,815,408 A | | 3/1989 | Burd | 114/109 |
| 5,233,716 A | | 8/1993 | Hicks | 7/165 |
| 5,595,378 A | * | 1/1997 | Martinsson et al. | 269/210 |
| 6,062,553 A | * | 5/2000 | Strehl | 269/43 |
| 6,105,948 A | * | 8/2000 | Young | 269/43 |

FOREIGN PATENT DOCUMENTS

| | | | |
|---|---|---|---|
| GB | 2286552 A | 8/1995 | B26B/1/04 |
| GB | 2297510 A | 8/1996 | B25F/1/04 |

* cited by examiner

*Primary Examiner*—Lee D. Wilson
(74) *Attorney, Agent, or Firm*—Richard C. Litman

(57) ABSTRACT

An apparatus for reeving and spacing deadeyes and sheaves for model sailing ships. The apparatus has a base for support, a spacing block that is used for measuring off a set distance between the deadeyes and sheaves being reeved and a pair of clamping jaws to hold a plurality of deadeyes and sheaves in place while being reeved and threaded. The clamping jaws are set on the base and at the end of the spacing block. The spacing block is a raised plateau with incremental pre-measured sections and channels for providing a set of distances between the deadeyes and sheaves being reeved. The apparatus also has a secondary spacing block to increase the distance between the incremental pre-measured sections and channels of the provided spacing block.

6 Claims, 3 Drawing Sheets

MODEL SHIP TOOL FOR REEVING AND SPACING DEADEYES AND SHEAVES

BACKGROUND OF THE INVENTION

1. Field of the Invention

The present invention relates to a tool for reeving and spacing deadeyes and sheaves on lanyards and shroud lines of model sailing ships.

2. Description of the Related Art

Boating and model ship building are two of America's favorite past-times. Rigging and reeving the lanyards and deadeyes of both real sailing ships and model sailing ships require the use of specific tools and procedures. Such tools for boating and model ship building are reflected in the prior art.

U.S. Pat. No. 3,871,127 issued to Heath, outlines a model sailing ship with an improved keel. The keel has a downwardly extending section attached to the hull and a horizontal extending section attached to the downwardly extending section. The keel is positioned so that the center of pressure of the wind acting on the ship is in a forward position, in relation to the center pressure of the water acting on the ship.

U.S. Pat. No. 4,412,499 issued to Hall, outlines the use of a connection assembly for marine rigging in the form of ropes and rods which employ a thick rigid internal tang that is mounted in an opening in a mast or other tubular member. A keyhole is formed in the tang in the opening in which is arranged to receive a key affixed to the end of the rigging. A pocket extends into the tang from the side inside the mast, at a point that is spaced vertically from the keyhole.

U.S. Pat. No. 4,815,408 issued to Burd, outlines a clamping device adapted to receive in each of two linearly spaced members the distal end of a shroud line and a deck plate mount, the members being moveable along a threaded shaft to draw the distal end of the shroud line toward the deck plate member for attachment to. A gauge for determining precisely the linear relationship between the distal end of the shroud line and the deck plate is also provided.

U.S. Pat. No. 5,233,716 issued to Hicks, outlines in general a rigging tool that is used for windsurfing. The rigging tool is compact, wear resistant, can serve most of the rigging requirements for setting-up a windsurfer and is suitable for mass production at a low cost using several methods of manufacture.

Great Britain Patents No. 2,286,552 and Patent No. 2,297,510 granted to Foxall, outline a one-piece, multi-purpose rigging tool incorporating a swinging handle attached by a pivot partway along, the length of the blade, enabling either side or end of the blade to be partially enclosed in the handle. There is also a catch on the handle to secure it in such a working position when the other end of the blade is in use.

Although each of these patents outline a novel and useful invention involving either boating or model sailing ship building, what is really needed is a tool to more easily reeve and space deadeyes and sheaves on lanyards and shroud lines of model sailing ships. With the popularity of model sailing ship building being so thigh, such a tool would definitely be in demand in the marketplace.

None of the above inventions and patents, taken either singularly or in combination, is seen to describe the instant invention as claimed. Thus a model ship tool for reeving and spacing deadeyes and sheaves solving the aforementioned problems is desired.

SUMMARY OF THE INVENTION

The invention is an apparatus for reeving and spacing deadeyes and sheaves for model sailing ships. The apparatus has a base for support, a spacing block that is used for measuring off a set distance between the deadeyes and the sheaves being reeved and a pair of clamping jaws to hold a plurality of deadeyes and sheaves in place while being reeved and threaded, the clamping jaws being set on the base and at the opposite end of the spacing block. The spacing block is a raised plateau with incremental pre-measured sections and channels for providing a set of distances between the deadeyes and sheaves being reeved. The apparatus also has a secondary spacing block to increase the distance between the incremental pre-measured sections and channels of the provided spacing block.

Accordingly, it is a principal object of the invention to provide a tool for reeving and spacing deadeyes used with rigging or shroud lines of model ships.

It is another object of the invention to provide a tool for reeving the deadeyes and sheaves of a model ship in a desired sequence.

It is a further object of the invention to provide a tool for spacing the deadeyes and sheaves of a model ship a specific measured distance apart.

It is another object of the invention to provide a tool for holding single sheave, double sheave and triple sheave blocks prior to reeving or threading with various rigging or shroud lines of a model ship.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
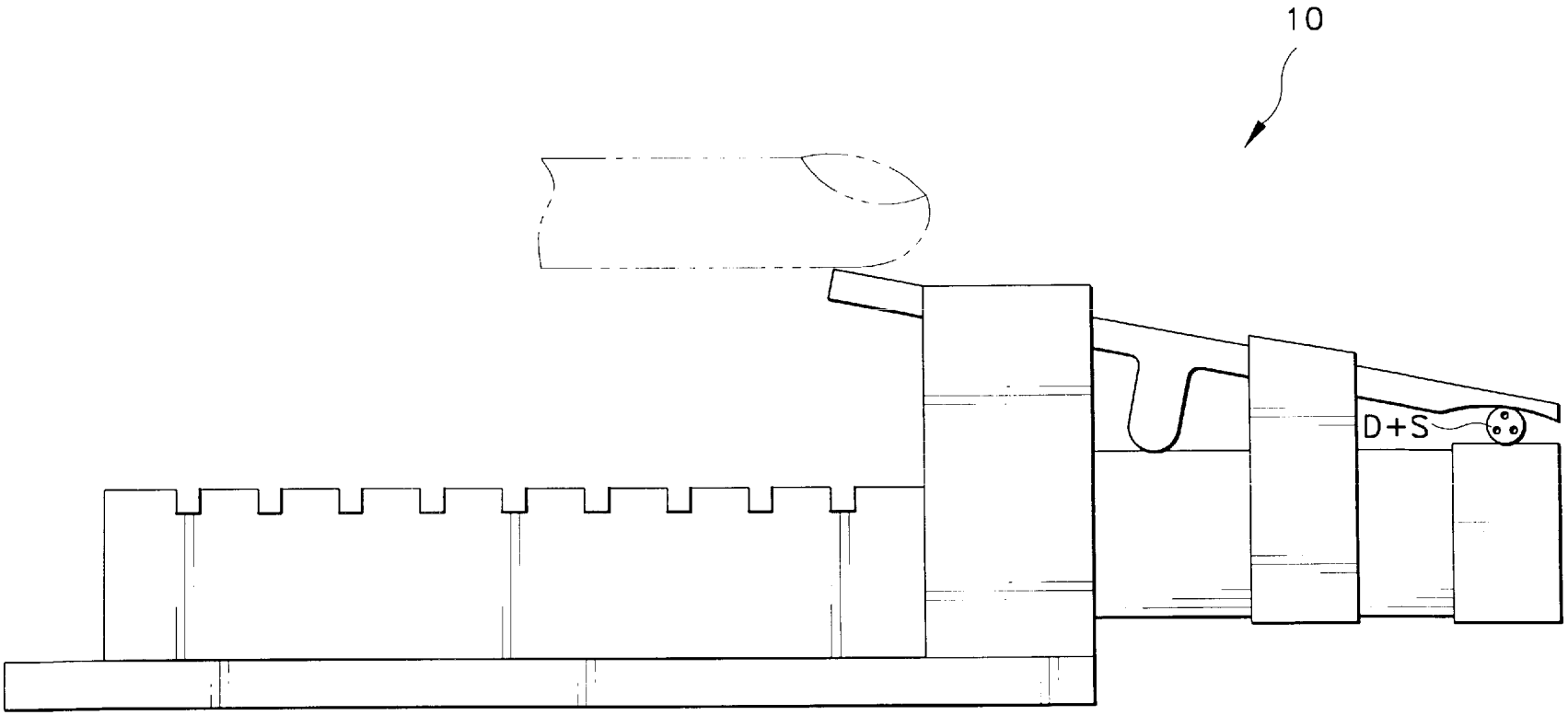
FIG. 1 is a side perspective view of a model ship tool for reeving and spacing deadeyes and sheaves according to the present invention.

The present invention is an apparatus 10 for reeving and spacing deadeyes and sheaves D&S for model sailing ships, as is depicted in FIG. 1. Specifically, this is done for lanyard lines LL and shroud lines SL that are either supplied with a model sailing ship kit or that can be purchased separately.

The apparatus 10 comprises a base 20 for support, a spacing block 30 that is used for measuring off a set distance between the deadeyes and sheaves D&S being reeved and a pair of clamping jaws 40 to hold a plurality of deadeyes and sheaves D&S in place while being reeved and threaded with a lanyard line LL and a shroud line SL. The spacing block 30 is placed in the center of the base 20 and the clamping jaws 40 are also set on the base 20 and at the end of the spacing block 30. Typically, a user will first thread a deadeye and sheave D&S with a lanyard line LL or shroud line SL using the clamping jaws 40 and then transfer the work in progress assembly deadeye and sheath D&S to the spacing block 30.

The spacing block 30 is a raised plateau with incremental pre-measured sections 34 and channels 36 for providing a set of distances between the deadeyes and sheaves D&S being reeved. The diameter of the deadeye and sheave D&S usually ranges from 3/32" to 45/64". The shroud line SL should be cut to the required length for the model sailing ship and tied around the circumference of the deadeye or sheave D&S. A knot should be tied and positioned in relation to one of the three holes on the deadeye and sheave D&S and a drop of glue should also be applied to fasten and secure the SL line in place.

After the glue dries, one of the deadeye and sheave D&S is positioned with a shroud line SL attached under each clamping jaw 40, positioning it parallel to the clamping jaw 40 or setting it at an angle if desired. The lanyard line LL should be cut to the proper length required and a knot tied on one end of the lanyard line LL. The user can then begin to reeve the lanyard line LL thru the holes in the deadeye and sheave D&S following the desired proper hole sequence. The deadeye and sheave D&S (not shown) assembly is now ready for the proper spacing operation by utilizing the spacing block 30. The spacing of the deadeyes and sheaves D&S is accomplished by placing the reeved assembly into the desired measured channel 36 called for in the plans of the model sailing ship. The proper spacing is achieved by simply adjusting and tightening the lanyard line LL with the end sides of the pre-measured sections 34. Overall, the spacing block 30 will allow the deadeyes and sheaves D&S to be spaced from ¼" to ¾" in increments of 1/16".

Figure 2:
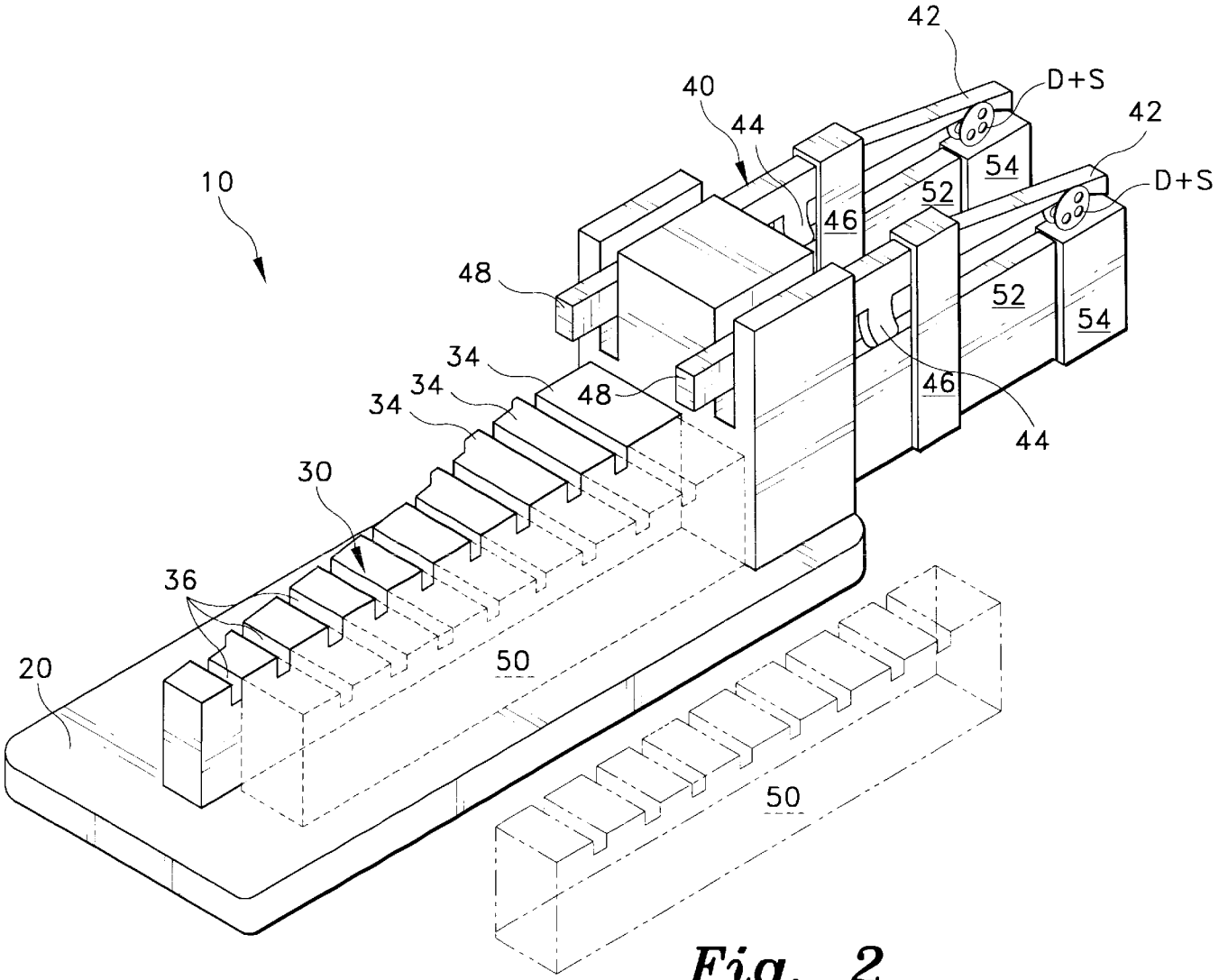
FIG. 2 is a top side perspective view of a model ship tool for reeving and spacing deadeyes and sheaves.
Figure 3:
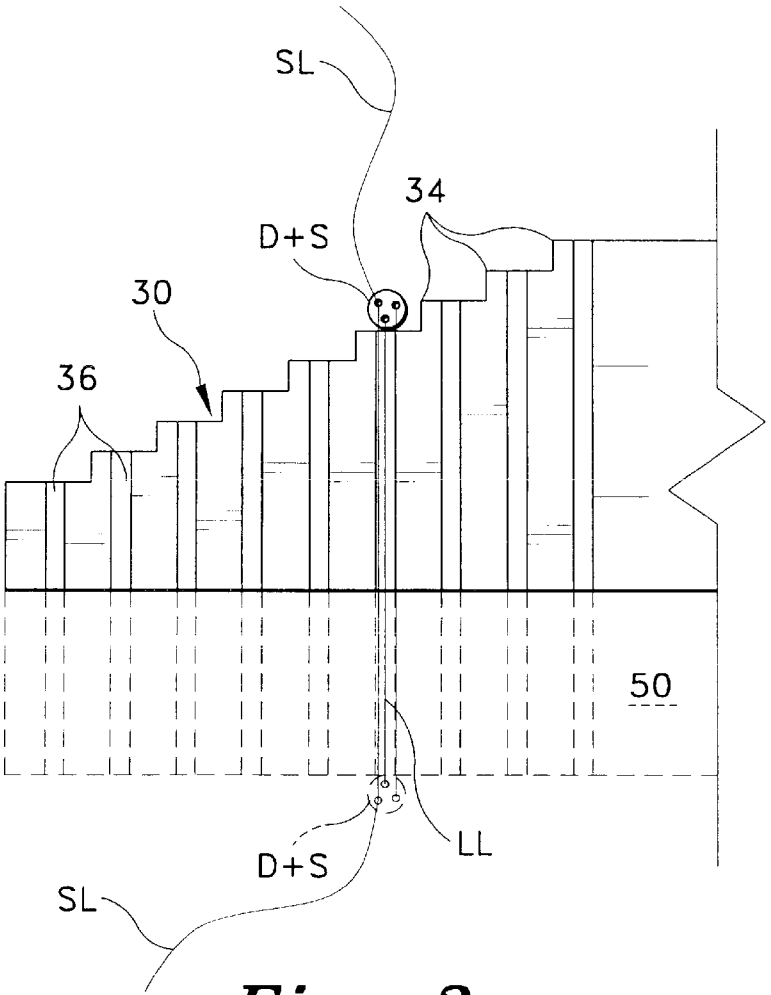
FIG. 3 is a top perspective view of a model ship tool for reeving and spacing with a supplemental secondary spacer.

A secondary spacer block 50 is used to increase the distance between the incremental pre-measured sections 34 and channels 36 of the spacing block 30. With the secondary spacer block 50 in place, the apparatus 10 can make spacings of 3/41" to 1-¼" in increments of 1/16". The secondary spacer block 50 is placed on the base 20 adjacent to the straight side of the spacing block 30. The clamping jaws 40 of the apparatus 10 are a pair of levers 42 with built-in fulcrums 44, with the levers 42 being biased by a first plurality of rubber bands 46 adjacent to the fulcrums 44, as shown in FIG. 2. The first plurality of rubber bands 46 are the proper size, width and durometer to hold the deadeyes and sheaves D&S firmly in place against the two base bars 52.

The clamping jaws 40 each have a cantilevered end 48 that can be pushed down to release deadeyes and sheaves D&S being held by the clamping jaws 40. This results in a counter force against the biasing of the first plurality of rubber bands 46, which in turn holds the deadeyes and sheaves D&S against the two base bars 52. The apparatus 10 also has a second plurality of rubber bands 54, which are provided underneath the deadeyes and sheaves D&S being held by the two base bars 52 and the clamping jaws 40. The second plurality of rubber bands 54 are better able to hold the deadeyes and sheaves D&S than the plastic injection molding material that the apparatus 10 is made of. It was found that the smoothness of the plastic injection molding material of the two base bars 52 would not hold the deadeye assembly (not shown) and that they would pop out from underneath the clamping jaws 40. The second plurality of rubber bands 54 are the proper size, width and durometer to overcome this and hold the deadeye assembly firmly in place.

Operation and use of the apparatus 10 is uncomplicated. Deadeyes and sheaves D&S are manually placed under the clamping jaws 40 and the second plurality of rubber bands 54. While being held, the lanyard lines LL can be cut to the proper length and with a knot tied at one end proceed to reeve the D&S to their proper sequence. At this point the SL have already been added. Once reeved, the deadeyes and sheaves D&S can be spaced and sequenced as desired using the spacing block 30. The assembly is then transferred manually from the clamping jaws 40 to the desired spacing block 30 of the apparatus 10. Once transferred, the user chooses the desired spacing typically outlined by the model sailing ship instructions. As previously mentioned, this is done by selecting the appropriate pre-measured section 34 and channel 36 size on the spacing block 30. Lanyard lines LL to be spaced from ¼" to ¾" in 1/16" increments can be done with the spacing block 30 by itself, but spacings from ¾" to 1-¼" in 1/16" increments must be done with the secondary spacer block 50. Once the desired sequence and spacing has been completed, the user is then ready to provide the assembled model sailing ship rigging for his model sailing ship.

It is to be understood that the present invention is not limited to the embodiment described above, but encompasses any and all embodiments within the scope of the following claims.

I claim:

1. An apparatus for reeving and spacing deadeyes and sheaves for model ships, comprising:

a base for supporting the model ship tool;

a spacing block that is used for measuring off a set distance between the deadeyes and the sheaves being reeved, said spacing block being placed in the center of the base; and a pair of clamping jaws to hold a plurality of deadeyes and sheaves in place while being reeved and threaded with a lanyard line, the clamping jaws being set on the base and at the end of the spacing block, wherein the clamping jaws are a pair of levers and a fulcrum, said levers being biased by a first plurality of rubber bands adjacent to the fulcrum.

2. The apparatus according to claim 1, wherein said spacing block is a raised plateau with incremental pre-measured sections and channels for providing a set of distances between the deadeyes and sheaves being reeved.

3. The apparatus according to claim 2, further including a secondary spacer block to increase the distance between the incremental pre-measured sections and channels of the raised plateau.

4. The apparatus according to claim 3, wherein the secondary spacer block is placed on the base adjacent to a side of the raised plateau.

5. The apparatus according to claim 1, wherein the clamping jaws each have a cantilever end that can be pushed down to release deadeyes and sheaves being held by the clamping jaws.

6. The apparatus according to claim 1, wherein a second plurality of rubber bands are provided underneath the deadeyes and sheaves being held by the clamping jaws.

* * * * *